US011530668B2

(12) United States Patent
Dann et al.

(10) Patent No.: US 11,530,668 B2
(45) Date of Patent: *Dec. 20, 2022

(54) CLOSED CYCLE REGENERATIVE HEAT ENGINES

(71) Applicant: Stirling Works Global Ltd, Middlesex (GB)

(72) Inventors: Michael Dann, Middlesex (GB); Graham Nicholson, Middlesex (GB)

(73) Assignee: Stirling Works Global LTD, Middlesex (GB)

( * ) Notice: Subject to any disclaimer, the term of this patent is extended or adjusted under 35 U.S.C. 154(b) by 0 days.

This patent is subject to a terminal disclaimer.

(21) Appl. No.: 17/329,745

(22) Filed: May 25, 2021

(65) Prior Publication Data

US 2021/0277846 A1 Sep. 9, 2021

Related U.S. Application Data

(63) Continuation of application No. 16/649,759, filed as application No. PCT/GB2018/000125 on Sep. 24, 2018, now Pat. No. 11,022,067.

(30) Foreign Application Priority Data

Sep. 22, 2017 (GB) ..... 1715415
Feb. 28, 2018 (GB) ..... 1803276

(51) Int. Cl.
*F02G 1/043* (2006.01)
*F02G 1/053* (2006.01)
*F02G 1/044* (2006.01)

(52) U.S. Cl.
CPC ..... *F02G 1/0435* (2013.01); *F02G 1/043* (2013.01); *F02G 1/053* (2013.01); *F02G 1/044* (2013.01);

(Continued)

(58) Field of Classification Search
CPC ..... F02G 1/0435; F02G 1/053; F02G 1/044; F02G 2243/06; F02G 2270/30;

(Continued)

(56) References Cited

U.S. PATENT DOCUMENTS 3,678,685 A 7/1972 Low
3,802,196 A 4/1974 Franklin (Continued)

FOREIGN PATENT DOCUMENTS

DE 4442505 A1 6/1996
GB 1252258 A 11/1971

(Continued)

OTHER PUBLICATIONS

International Search Report for corresponding PCT/GB2018/000125 dated Jan. 21, 2019.

*Primary Examiner* — Mickey H France
(74) *Attorney, Agent, or Firm* — Patterson Intellectual Property Law, PC; Emily A. Shouse

(57) ABSTRACT

A closed cycle regenerative heat engine has a housing defining a chamber. A displacer is housed in the chamber. A power piston is housed in the chamber. The displacer is resiliently deformable from a rest condition in response to displace the working fluid in the chamber. The displacer may be a multi-start volute spring. The displacer may be provided with a heat storage reservoir to store heat received from a working fluid as the working fluid is displaced from a heating location in the chamber to a cooling location in the chamber and reject heat to the working fluid when the working fluid is displaced from the cooling location to the heating location. The resiliently deformable displacer may comprise two components with an air space defined between the two components.

20 Claims, 12 Drawing Sheets

(52) U.S. Cl.
CPC ..... *F02G 2243/06* (2013.01); *F02G 2270/30* (2013.01); *F02G 2270/85* (2013.01)

(58) Field of Classification Search
CPC ..... F02G 2270/85; F02G 2253/04; F02G 2258/00; F02G 2270/55; F02G 1/057; F02G 1/043
USPC ..... 60/508–515, 516–526; 62/6, 238.2
See application file for complete search history.

(56) References Cited

U.S. PATENT DOCUMENTS

| | | | | |
|---|---|---|---|---|
| 4,019,335 | A * | 4/1977 | Browning | F02G 1/0435 62/6 |
| 4,209,980 | A * | 7/1980 | Pronovost | F01B 3/0026 60/517 |
| 4,642,995 | A | 2/1987 | Bachler | |
| 4,922,722 | A | 5/1990 | Kazumoto | |
| 2008/0263910 | A1 * | 10/2008 | Schoenmaker | E02F 3/439 37/348 |
| 2014/0026596 | A1 * | 1/2014 | Morie | F25B 7/00 62/6 |
| 2015/0247491 | A1 * | 9/2015 | Steiner | F02G 1/043 60/518 |

FOREIGN PATENT DOCUMENTS

| | | | |
|---|---|---|---|
| JP | S5537540 | A | 3/1980 |
| JP | 055479 | A | 1/1993 |
| JP | 2001090607 | A | 4/2001 |
| JP | 2008261520 | A | 10/2008 |

* cited by examiner

CLOSED CYCLE REGENERATIVE HEAT ENGINES

CROSS-REFERENCES TO RELATED APPLICATIONS

This application claims benefit of the following patent application(s) which is/are hereby incorporated by reference: U.S. application Ser. No. 16/649,759 which entered the National Stage on Mar. 23, 2020; which is a 371 application of PCT/GB2018/000125 filed Sep. 24, 2018; which claims priority to GB 1715415.4 filed Sep. 22, 2017; and GB 1803276.3 filed Feb. 28, 2018.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The invention relates to closed cycle regenerative heat engines.

A closed cycle regenerative heat engine is an external combustion engine that operates by cyclic heating and cooling of a gaseous working fluid. Such engines include a heat exchanger known as a regenerator that is arranged to take heat from the working fluid as the working fluid moves to a cool part of the engine and return the heat to the working fluid when it moves back from the cool part of the engine towards a hot part of the engine at which heat is applied to the working fluid from an external source. Such engines are often referred to as Stirling engines.

BRIEF SUMMARY OF THE INVENTION

The invention provides a closed cycle regenerative heat engine comprising:

a housing defining a chamber;

a displacer housed in said chamber; and a movable member housed in said chamber, said displacer comprises a first body member, a second body member and a thermally insulating member intermediate said first and second body members and configured such that when said displacer moves to displace said working fluid into said cooling location, said first body member moves into said heating location and when said displacer moves to displace said working fluid into said heating location, said second body member moves into said cooling location, said displacer further comprises a heat storage reservoir mounted on said thermally insulating member to, in use, store heat received from said working fluid when said working fluid is displaced from said heating location to said cooling location and reject said stored heat to said working fluid when said working fluid is displaced from said cooling location to said heating location, and said movable member is in sealing engagement with said housing and movable in response to pressure changes of said working fluid caused by said heating and cooling of said working fluid to provide a mechanical power output.

wherein said displacer is movable in said chamber to displace a working fluid between respective heating and cooling locations in said chamber at which heat is input to said working fluid and said working fluid is cooled.

The invention also provides a closed cycle regenerative heat engine comprising:

a housing defining a chamber;

a resiliently deformable displacer housed in said chamber; and a movable member housed in said chamber, wherein said displacer is movable in said chamber to displace a working fluid between respective heating and cooling locations in said chamber at which heat is input to said working fluid and said working fluid is cooled, said displacer defines an internal through-passage such that, in use, when said displacer moves to displace said working fluid between said heating and cooling locations, said working fluid passes through said displacer, a heat storage reservoir mounted on said resiliently deformable displacer to, in use, store heat received from said working fluid when said working fluid is displaced from said heating location to said cooling location and reject said stored heat to said working fluid when said working fluid is displaced from said cooling location to said heating location, and said movable member is in sealing engagement with said housing and movable in response to pressure changes of said working fluid caused by said heating and cooling of said working fluid to provide a mechanical power output.

The invention also provides a closed cycle regenerative heat engine comprising:

a housing defining a chamber;

a displacer housed in said chamber; and a movable member housed in said chamber, wherein said displacer is movable in said chamber to displace a working fluid between respective heating and cooling locations in said chamber at which heat is input to said working fluid and said working fluid is cooled, said displacer comprises a first body portion and a second body portion disposed in opposite said first body portion and configured such that when said displacer moves to displace said working fluid into said cooling location, said first body portion moves into said heating location and when said displacer moves to displace said working fluid into said heating location, said second body portion moves into said cooling location, wherein a gap is defined between said first and second body portions to at least reduce heat conduction between said first and second body portions, and said movable member is in sealing engagement with said housing and movable in response to pressure changes of said working fluid caused by said heating and cooling of said working fluid to provide a mechanical power output.

The invention also includes a closed cycle regenerative heat engine comprising a displacer that in use reciprocates in a chamber displace a working fluid between respective heating and cooling locations, wherein said displacer comprises a multi-start volute spring.

The invention also includes a closed cycle regenerative heat engine comprising a displacer that in use reciprocates in a chamber displace a working fluid between respective heating and cooling locations, wherein said displacer is provided with an internal through-passage through which said working fluid passes when displaced between said heating and cooling locations and a heat storage reservoir housed in said through-passage to store heat received from said working fluid when said working fluid is being displaced from said heating location to said cooling location and reject heat to said working fluid when said working fluid is being displaced from said cooling location to said heating location.

The invention also includes a closed cycle regenerative heat engine comprising a displacer that in use reciprocates in a chamber to displace a working fluid between respective heating and cooling locations, wherein said displacer comprises a first body portion and a second portion and said first and second portions are at least partially separated to define a thermally insulating space therebetween.

BRIEF DESCRIPTION OF THE SEVERAL VIEWS OF THE DRAWINGS

In the disclosure that follows, reference will be made to the drawings in which.

DETAILED DESCRIPTION OF THE INVENTION

Figure 1:
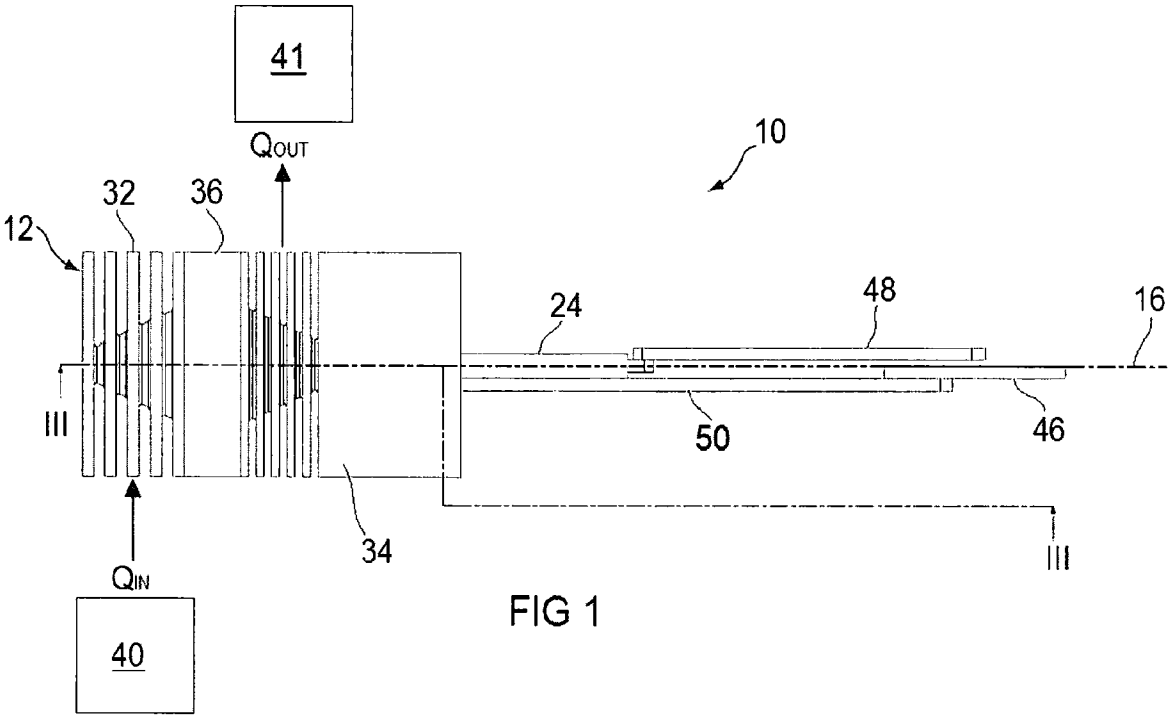
FIG. 1 is a side elevation of an example of a closed cycle regenerative heat engine.
Figure 2:
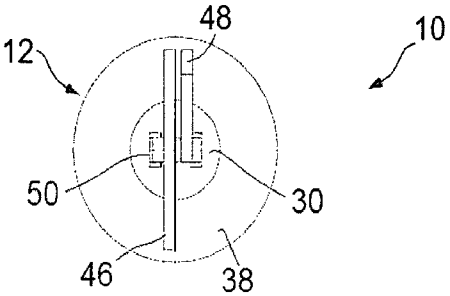
FIG. 2 is an end elevation of the closed cycle regenerative heat engine of FIG. 1.
Figure 3:
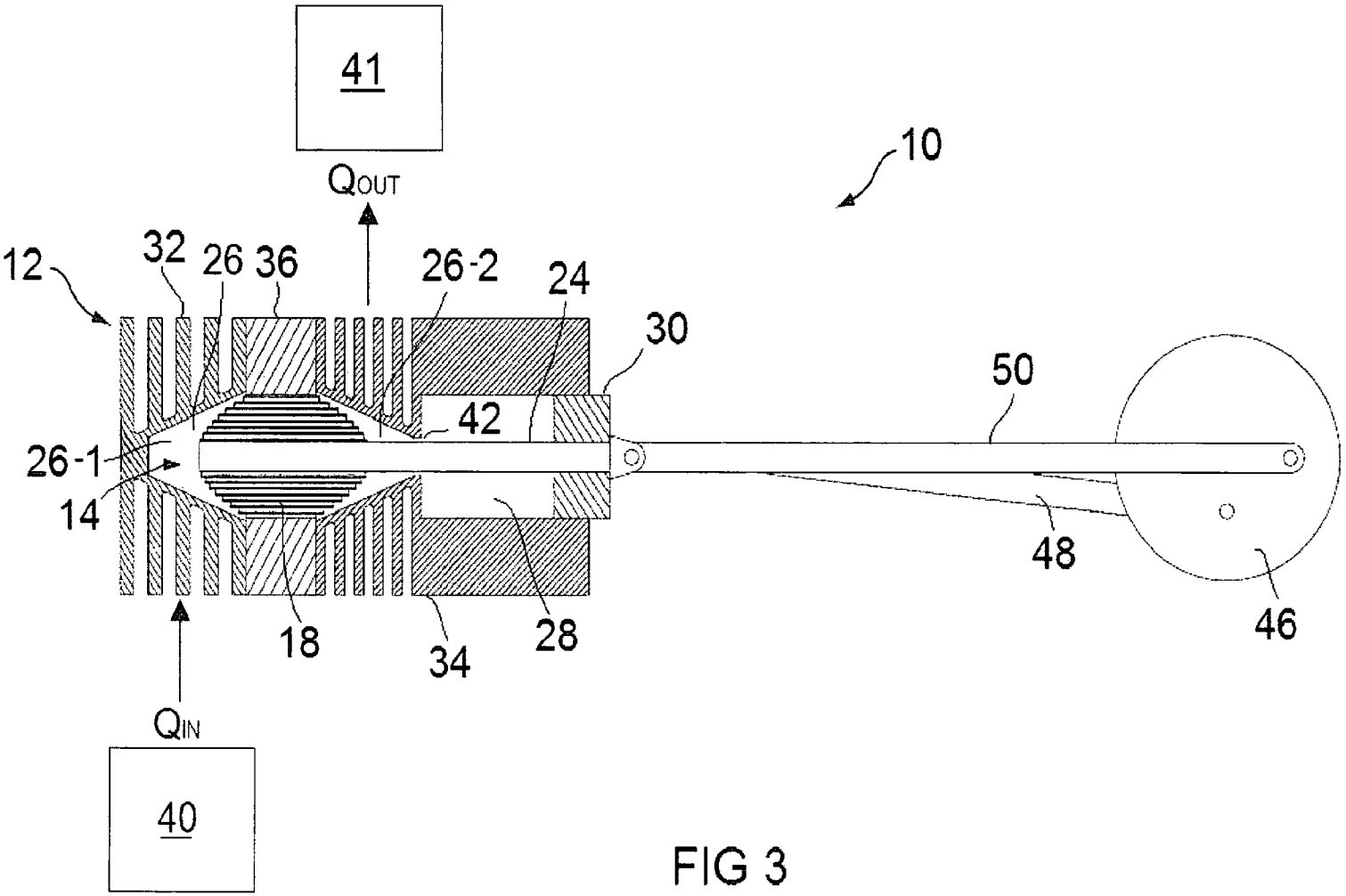
FIG. 3 is a section view on line III-III in FIG. 1.

Referring to FIGS. 1 to 3, a closed cycle regenerative heat engine 10 comprises a housing 12 defining a chamber 14 that has a longitudinal axis 16. The engine 10 further comprises a displacer 18 to displace a gaseous working fluid in the chamber 14 between respective heating and cooling locations in said chamber at which heat is input to the working fluid and the working fluid is cooled. The displacer 18 is secured to the housing 12 and to a shaft 24 that extends along the chamber 14. The displacer 18 is resiliently deformable. Deformation of the displacer 18 in response to movement of the shaft 24 causes parts or portions of the displacer to move between the heating location and cooling location to displace the working fluid.

Referring particularly to FIG. 3, the chamber 14 is configured to define a displacer compartment 26 that houses the displacer 18 and a piston compartment 28 that houses a power piston 30. In the illustrated example the displacer and piston compartments 26, 28 are defined by respective end regions of the chamber 14. The displacer 18 and power piston 30 are each movable in the axial direction of the chamber 14. The displacer and piston compartments 26, 28 are in fluid communication so that working fluid in the chamber 14 can flow between the two compartments.

The housing 12 comprises a first housing portion 32, a second housing portion 34 and a thermally insulating portion 36 disposed intermediate the first and second housing portions. The first housing portion 32 is arranged to receive heat $Q_{IN}$ from a heat source 40 and may be provided with fins or other surface area enhancers to facilitate heat transfer between relatively cool working fluid in the chamber 14 and the heat source. The heat source 40 may, for example, comprise one or more solar panels that heat a fluid such as water. The first housing portion may, for example, be at least partially surrounded by a body or assembly defining a water jacket supplied with hot water used to heat the first housing portion 32. At least a part of the second housing portion 34 is arranged to reject heat $Q_{out}$ from the working fluid in the chamber 14 to an external cold zone 41. The second housing portion 34 may be provided with fins or other surface area enhancers to facilitate the transfer of heat from the relatively warmer working fluid to the external cold zone 41. The external cold zone 41 may take any form capable of receiving heat from the second housing portion 34 to cool the working fluid in the chamber 14 and may, for example, be ambient air or a cold-water jacket that at least partially surrounds the second housing portion 34.

The displacer compartment 26 of the chamber 14 may vary in diameter along at least portions of its length. In the illustrated example, the displacer compartment 26 has two oppositely directed frusto-conical portions 26-1, 26-2, respectively defined by the first and second housing portions 32, 34, and a circular section portion separating the two frusto-conical portions. The circular section portion may be defined by the thermally insulating portion 36 of the housing 12. The displacer 18 is secured to the housing 12 at, for example, the thermally insulating portion 36 and is movable by deformation into both frusto-conical portions 26-1, 26-2 of the displacer compartment 26. Since the frusto-conical portion 26-1 is defined by the first housing portion 32 (which in use receives heat $Q_{IN}$ from the heat source 40) and the frusto-conical portion 26-2 is defined by the second housing portion 34 (which in use rejects heat $Q_{out}$ to the external cold zone 41) and they are separated by the thermally insulating portion 36, there will be temperature gradient between them. Accordingly, for ease of reference, in the description that follows the frusto-conical portion 26-1 will be referred to as the hot end of the displacer chamber and the frusto-conical portion 26-2 will be referred to as the cold end of the displacer compartment. It is to be understood that the terms 'hot' and 'cold' are used in a relative sense as convenient labels to indicate that, in use, there is a temperature difference between the two ends of the displacer compartment 26 so that the hot end 26-1 is a location in the chamber 14 at which the working fluid is heated and the cold end 26-2 is a location in the chamber at which the working fluid is cooled and beyond this, the terms should not be interpreted restrictively such as to limit the scope of the invention defined by the claims.

The piston compartment 28 of the chamber 14 has a constant diameter and is in fluid communication with the displacer compartment 26, for example, via an opening 42 disposed adjacent the narrow end of the frusto-conical cold end 26-2 of the displacer compartment. The opening 42 may be defined by the second housing portion 34. The shaft 24 extends from the displacer compartment 26 into the piston compartment 28 via the opening 42. The shaft 24 passes through an axially extending through-hole provided in the power piston 30 and out of the piston compartment 28. The end of the shaft 24 disposed remote from the displacer 18 and outside of the chamber 14 is connected with a flywheel 46. The shaft 24 may be connected with the flywheel 46 by a connecting shaft, or link, 48. The connection to the flywheel 46 allows the displacer 18 to receive stored mechanical energy from the flywheel to cause the displacer to deform to move working fluid between the hot and cold ends 26-1, 26-2 of the displacer compartment 26. The piston 30 is connected with the flywheel 46 by a piston shaft, or link, 50. The shafts 24, 50 are connected with the flywheel 46 such that they are 90° out of phase.

Figure 5:
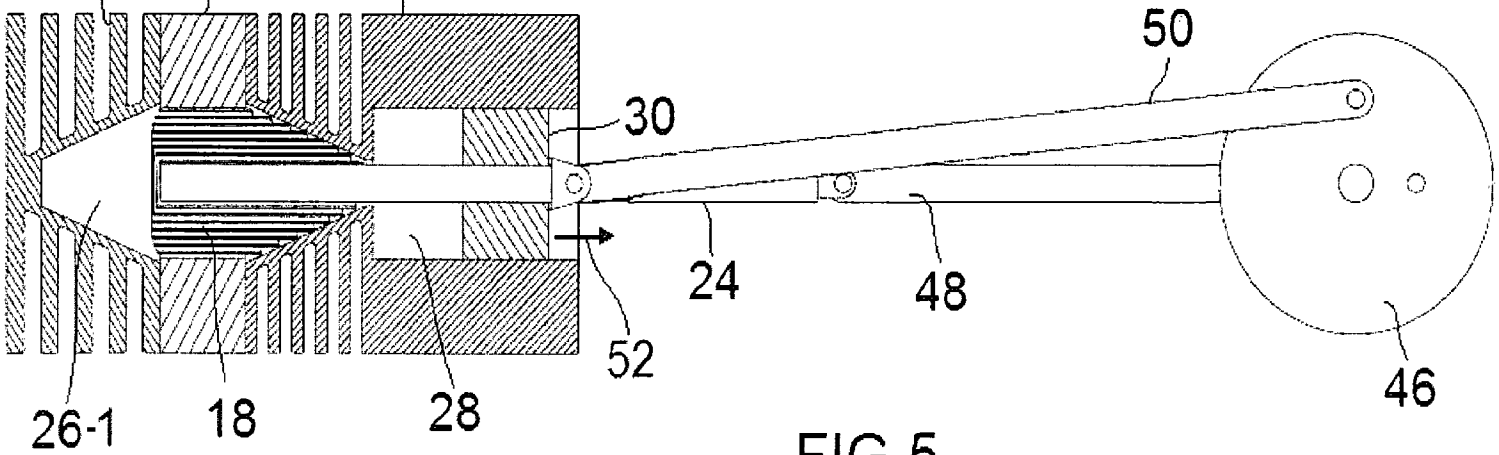
Figure 8:
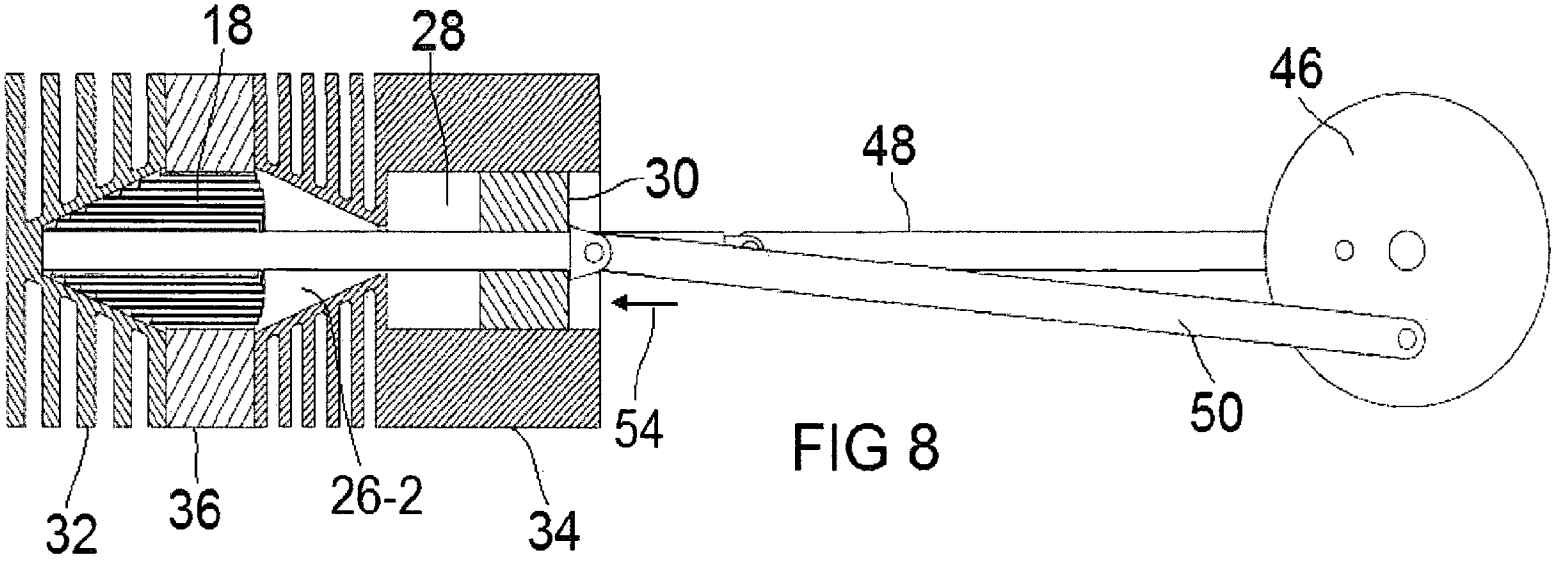

The displacer 18 comprises a volute spring, which in the illustrated example comprises a resilient strip having a first, or starting, end connected with the housing 12 and a second end connected with the shaft 24. The resilient strip winds about the shaft 24 to form a coil having an axis generally coincident with the longitudinal axis 16 of the chamber 14. In the illustrated example, the first end of the resilient strip is fixedly connected with the thermally insulating portion 36 of the housing 12 and the second end is fixedly connected with the shaft 24 so that the displacer 18 is secured to the housing 12 and is forced to deform when the shaft 24 reciprocates in the chamber 14. Since the first end of the resilient strip is fixedly connected with the housing 12 and the second end moves with the shaft 24 when the shaft reciprocates in the chamber 14, the displacer 18 may deform from the condition shown in FIG. 3 to respective first and second conditions in which it at least substantially fills the frusto-conical hot and cold ends 26-1, 26-2 of the displacer compartment 26. Examples of the displacer 18 at least substantially filling the respective hot and cold ends 26-1, 26-2 of the displacer compartment 26 can be seen in FIGS. 5 and 8. This deformation of the displacer 18 causes it to displace working fluid in the displacer compartment 26 to move it between the hot and cold ends 26-1, 26-2 so as to bring the working fluid into contact with the first and second housing portions 32, 34 to be heated and cooled respectively.

The heating of the working fluid by contact with the first housing portion 32 causes it to expand. The expansion of the working fluid at the hot end 26-1 drives the power piston 30 away from the displacer compartment 26 on its outward, or power, stroke. The cooling of the working fluid at the cold end 26-2 by contact with the second housing portion 34 causes it to contract, allowing the power piston 30 to move back towards the displacer compartment 26 of the chamber 14 on its inward, or return, stroke. The relative displacement of the displacer 18 and movement of the power piston 30 are illustrated by FIGS. 4 to 9, which show a full cycle of the closed cycle regenerative heat engine 10.

Figure 4:
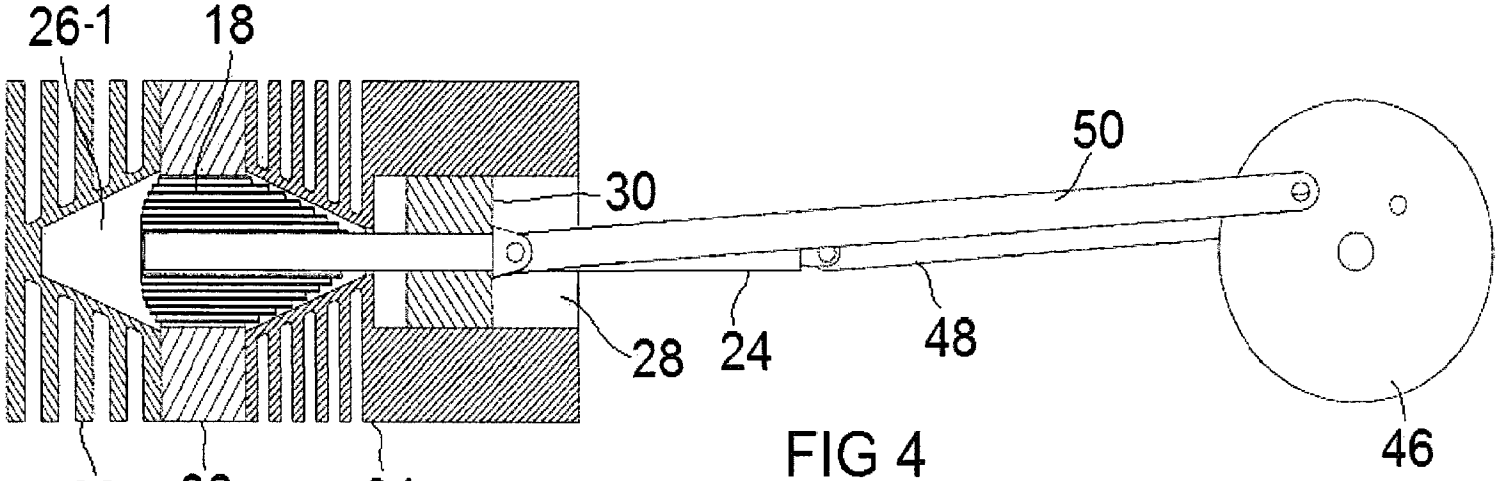
FIG. 4 through FIG. 9 are views corresponding to FIG. 3 illustrating a cycle of the closed regenerative heat engine.
Figure 6:
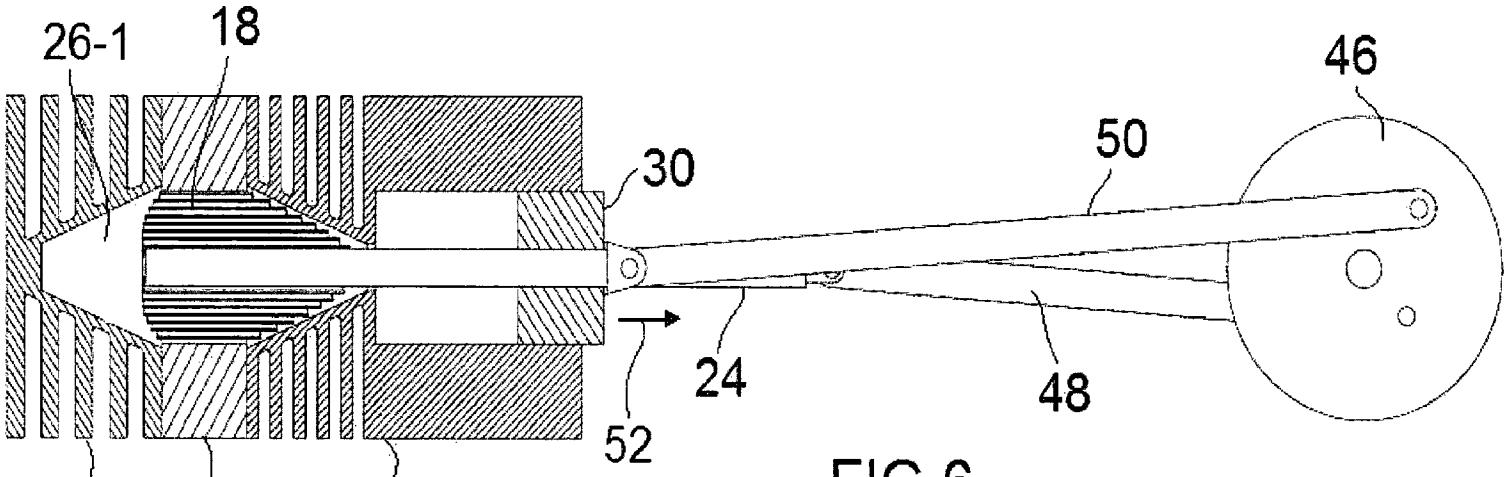
Figure 7:
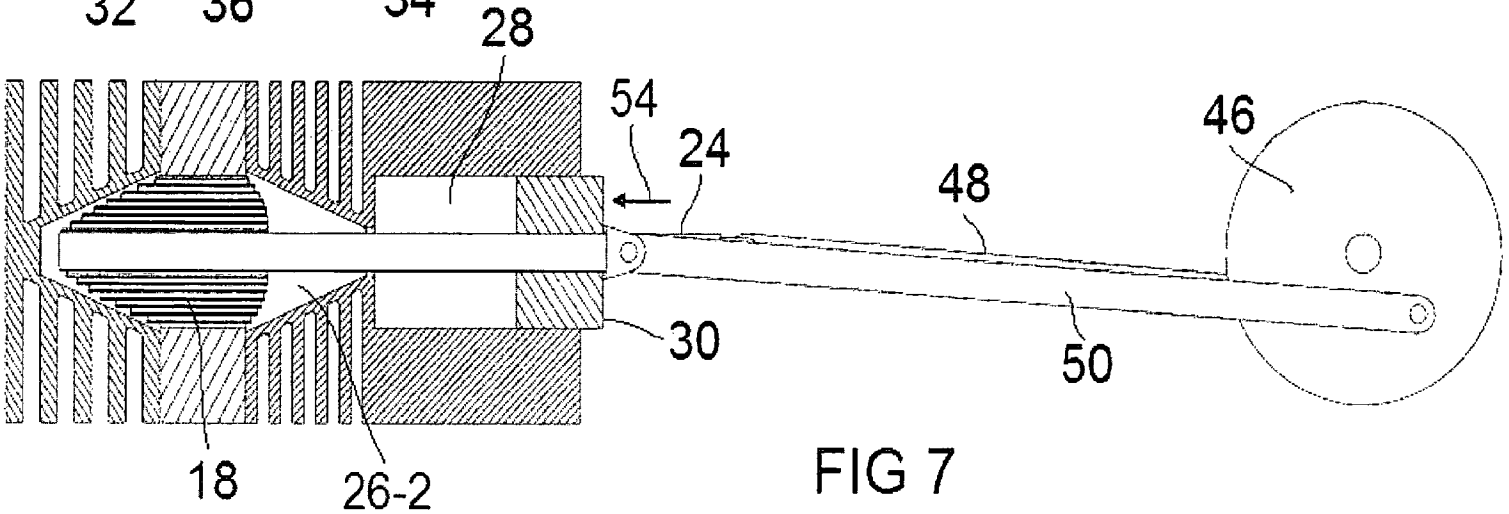
Figure 9:
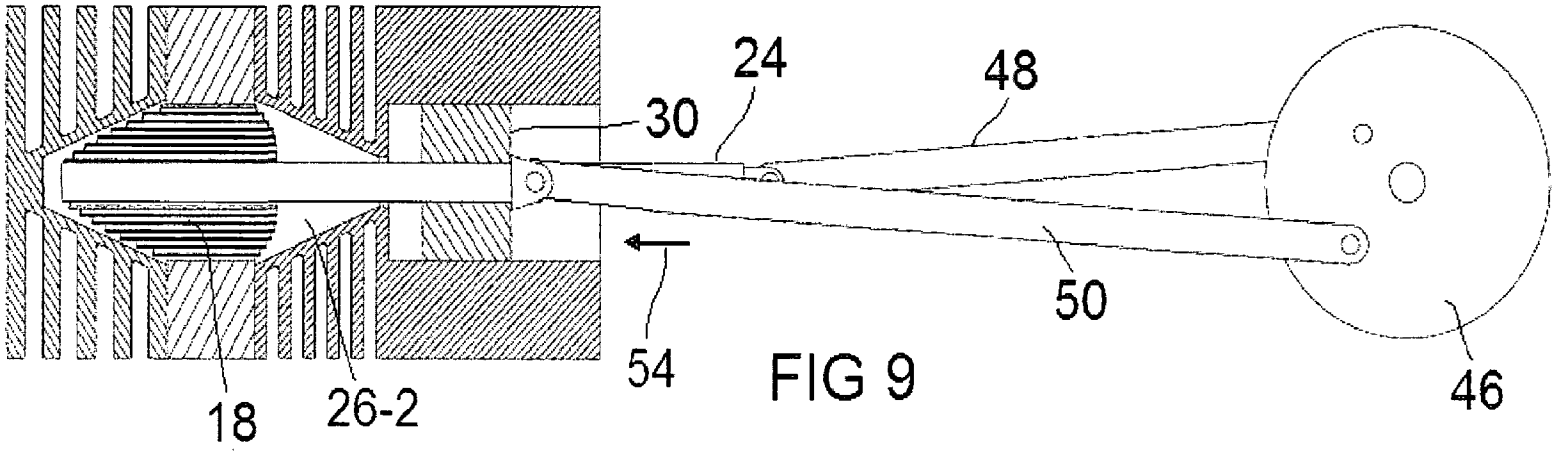

Referring to FIG. 4, most of the working fluid is at the hot end 26-1 of the displacer compartment 26 and the power piston 30 is at least substantially at the end of its return stroke at which it is disposed the closest it gets to the displacer compartment. The working fluid at the hot end 26-1 receives heat $Q_{IN}$ from the heat source 40. The heating of the working fluid causes it to expand. The expanding working fluid drives the power piston 30 away from the displacer compartment 26-1 on its power stroke as indicated by the arrow 52 in FIG. 5. The outwards translational movement of the power piston 30 is transmitted to the flywheel 46 by the shaft 50 causing the flywheel to rotate clockwise (as viewed in the drawings). FIG. 6 shows the power piston 30 close to the end of its power stroke at which is disposed the furthest it gets from the displacer compartment 26. At this stage, the momentum of the flywheel 46 provides mechanical energy to cause the displacer 18 to move from cold end 26-2 of the displacer compartment 26 to the hot end 26-1. As shown in FIG. 7, as the displacer 18 moves into the hot end 26-1 of the displacement compartment, the working fluid is displaced to the cold end 26-2. The working fluid does not pass around the displacer 18 as it would in a conventional Stirling engine, but instead passes between the coils of the displacer, which effectively defines at least one through passage through which the working fluid passes as it moves between the hot and cold ends 26-1, 26-2 of the displacer compartment 26. When at the cold end 26-2, the working fluid rejects heat $Q_{out}$ to the external cold zone 41 via the second housing portion 34. The cooling of the working fluid at the cold end 26-2 causes it to contract so that the power piston 30 is drawn inwardly towards the displacer compartment 26 as indicated by the arrow 54 in FIGS. 8 and 9. FIG. 9 shows the power piston approaching the end of its return stroke and the displacer 18 commencing its movement from the hot end 26-1 towards the cold end 26-2 to return to the position shown in FIG. 4. The mechanical energy to move the displacer from the hot end 26-1 to the cold end 26-2 is provided by the flywheel 46. As the displacer 18 moves into the cold end 26-2, the working fluid is again displaced to the hot end 26-1 and the cycle described above repeats. Thus, the displacer 18 reciprocates in the displacer compartment 26 to move the working fluid between the hot and cold ends 26-1, 26-2 and the power piston 30 reciprocates in the piston compartment 28 in response to the changing pressure of the working fluid as it is heated and cooled to provide a mechanical power output. Although not essential, in this example the mechanical power output provided by the closed cycle regenerative heat engine 10 is delivered to the flywheel 46. In other examples, the mechanical power output may be delivered to a crankshaft or an electric generator.

Figure 10:
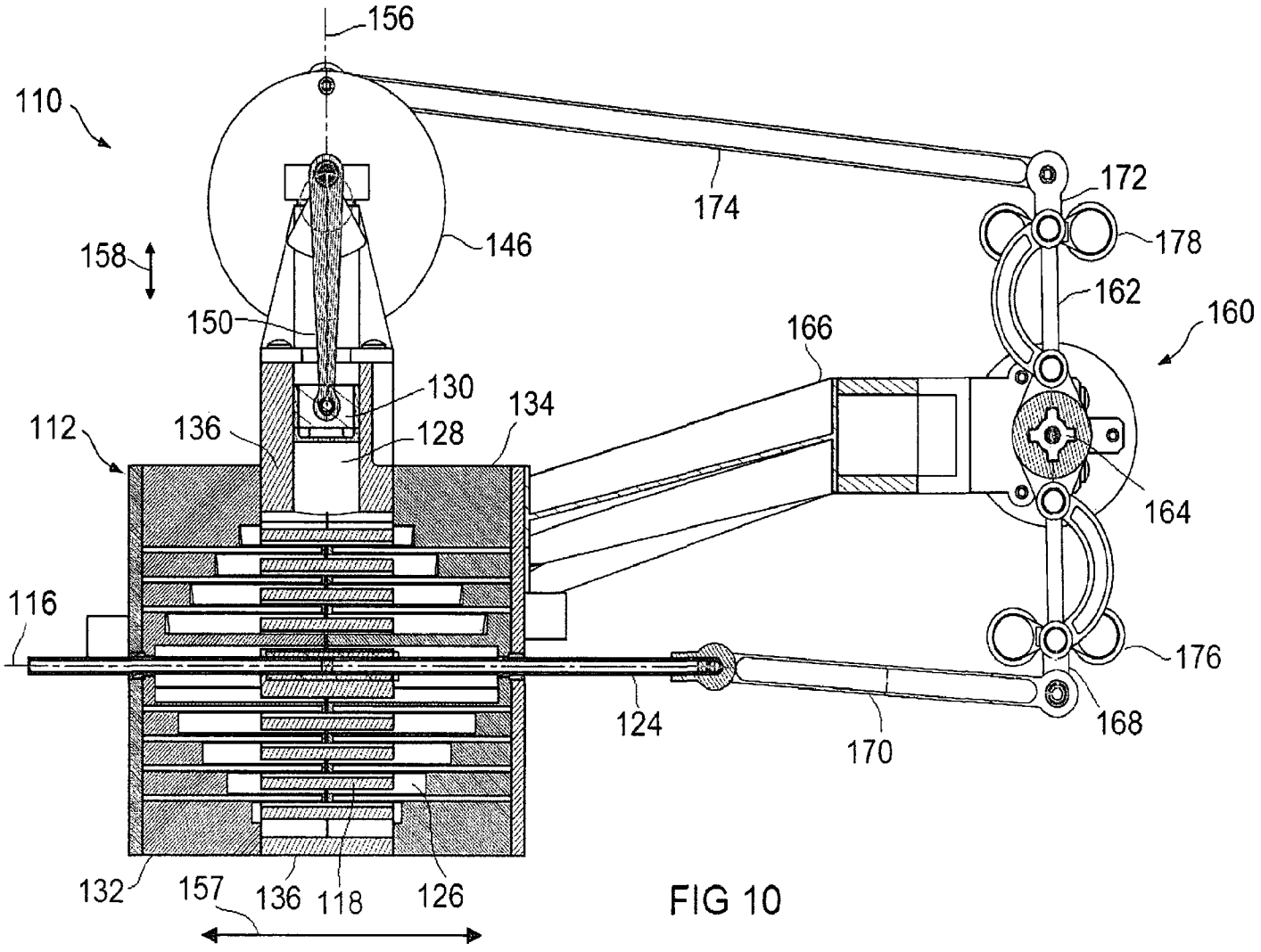
FIG. 10 is a section view of another example of a closed cycle regenerative heat engine.
Figure 11:
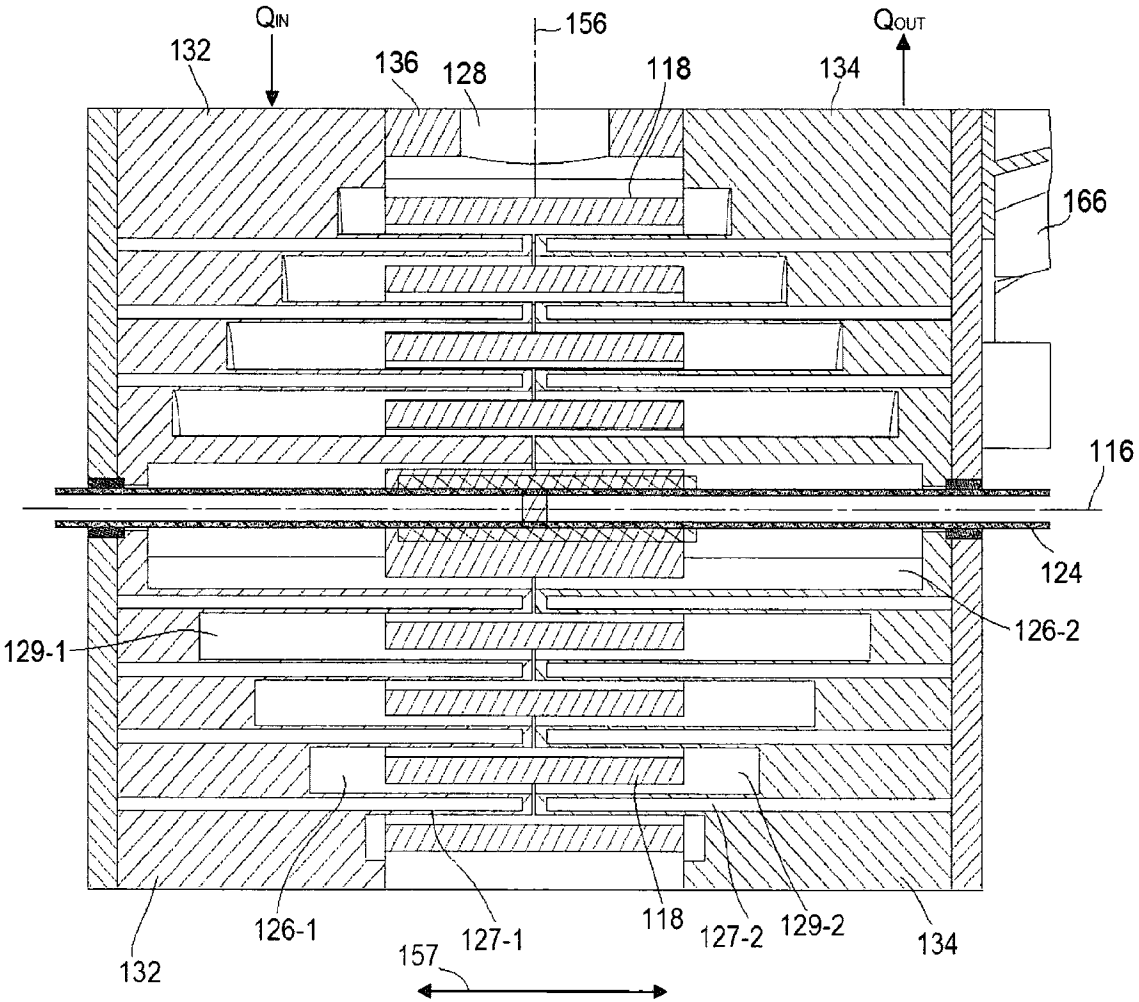
FIG. 11 is an enlargement of a portion of FIG. 10.

FIGS. 10 and 11 show another example of a closed cycle regenerative heat engine 110. Features of the closed cycle regenerative heat engine 110 that are the same as or similar to features of the closed cycle regenerative heat engine 10 are indicated by the same reference numerals incremented by 100 and may not be described in detail again.

The closed cycle regenerative heat engine 110 comprises a housing 112 defining a chamber that has a displacer compartment 126 and a piston compartment 128. A resiliently deformable displacer 118 is housed in the displacer compartment 126. A power piston 130 is housed for reciprocating movement in the piston compartment 128. The piston compartment 128 is in fluid communication with the displacement compartment 126 so that working fluid heated in the displacement compartment can act on the power piston 130. As in the previous example, the displacer compartment 126 varies in diameter along its length. In particular, the hot end 126-1 increases in diameter towards the thermally insulating portion 136 and the cold end 126-2 decreases in diameter from the thermally insulating portion towards the piston compartment 128. In this example, the piston compartment 128 is defined by a thermally insulating portion 136 of the housing 112 that is disposed between a first housing portion 132 at which heat $Q_{IN}$ is input to the chamber to heat the working fluid and a second housing portion 134 at which heat $Q_{OUT}$ is rejected from the chamber to cool the working fluid.

As best seen in FIG. 11, the first and housing portions 132, 134 may be provided with projections 127-1, 127-2 extending into the displacer compartment 126 at the hot and cold ends 126-1, 126-2 of the compartment. The projections 127-1, 127-2 may define respective convoluted passages 129-1, 129-2 into which the displacer 118 moves at it reciprocates between the hot and cold ends 126-1, 126-2 of the displacer compartment 126. The projections 127-1, 127-2 may comprising spiraling walls. The projections 127-1. 127-2 may be configured such that the respective passages 129-1, 129-2 are at least substantially filled when the displacer 118 is at the respective ends of the displacer compartment 126 so that the displacer 118 is able to fill the hot and cold ends 126-1, 126-2. The projections 127-1, 127-2 may be integral parts of the first and second housing portions 132, 134 or separate components or assemblies fitted to the respective housing portions. The projections 127-1, 127-2 provide additional surface area for heat transfer at the hot and cold ends of the displacer compartment 126, which may improve the efficiency of the heat transfer process.

Referring to FIG. 11, the projections 127-1, 127-2 may be hollow. This provides the possibility of flowing a heated fluid, for example hot water, through the projection, or projections, 127-1 at the hot end 126-1 of the displacer compartment 126. Similarly, a cooling fluid, for example cold water, may be flowed through the projection, or projections, 127-2 at the cold end 126-2 of the displacer compartment 126. Providing fluid flow paths extending into the projections 127-1, 127-2 to allow a heating or cooling fluid respectively to flow into the projections may further enhance the efficiency of the heat transfer process.

In this example, the resiliently deformable displacer 118 displaces along a first axis 116 defined by the shaft 124 that is connected to the resiliently deformable displacer and the power piston 130 displaces along a second axis 156 defined by the piston compartment 128 of the chamber. The respective reciprocating movements of the resiliently deformable displacer 118 and power piston 130 are mutually perpendicular as indicated by the respective arrows 157, 158. Since the relative displacements of the resiliently deformable displacer 118 and power piston 130 are at 90° to one another, their connections with the flywheel 146, or crankshaft, are in phase and not 90° out of phase as in the closed cycle regenerative heat engine 10.

Referring to FIG. 10, the closed cycle regenerative heat engine 110 further comprises a frequency adjustor 160 that is connected with the resiliently deformable displacer 118. The frequency adjustor 160 is configured to act on the resiliently deformable displacer to adjust, modify or tune the natural frequency of the displacer 118. The frequency adjustor 160 comprises a rocker 162 mounted on a pivot 164. The pivot 164 is supported by an arm 166 that may be secured to the housing 112. A first end 168 of the rocker 162 is pivotally connected to an end of the shaft 124 via a link 170 and the second end 172 of the rocker is pivotally connected to an end of a link 174. The opposite end of the link 174 is connected to the flywheel 146 or a crankshaft connected with the power piston. The rocker 162 supports oppositely disposed weights 176, 178. The positioning of the weights 176, 178 can be changed to adjust the natural frequency of the displacer 118. Moving the weights 176, 178 radially inwards, towards the pivot 164, increases the natural frequency of the displacer, while moving the weights radially outwardly, away from the pivot 164, decreases its natural frequency. This allows the natural frequency of the displacer 118 to be tuned to match the drive speed of the engine.

The operation of the closed cycle regenerative heat engine 110 is analogous to the operation of the closed cycle regenerative heat engine 10 as illustrated by FIGS. 4 to 9 and so will not be described in detail again. In similar fashion to the displacer 18 of the closed cycle regenerative heat engine 10, the displacer 118 of the closed cycle regenerative heat engine 110 fills the hot and cold ends 126-1, 126-2 when it reaches the respective ends of its reciprocating motion between the two ends.

In the examples illustrated by FIGS. 1 to 13, the housing defines a chamber that has a displacer compartment and a piston compartment that respectively house a resiliently deformable displacer and a power piston. The displacer compartment is configured to have opposite ends that are shaped to correspond to the deformed shape of the resiliently deformable displacer at each end of its stroke and the two compartments are in fluid communication to allow working fluid heated in the displacer compartment to act on the power piston. In other examples, only one end of the chamber may be shaped to correspond to the deformed shape of the resiliently deformable displacer and the crown of the power piston may be provided with a depression shaped to receive the deformed resiliently deformable displacer at one end of its stroke. In such examples, there are no clearly defined displacer and piston compartments since the crown of the power piston effectively forms a wall of a notional displacer compartment.

The resiliently deformable displacer in the illustrated examples of a closed cycle regenerative heat engine acts as a spring so that the engine may be run at natural frequency, thereby minimizing power losses due to reciprocating movement in the engine. The resiliently deformable displacer may be configured such that it has relatively low stiffness so that the system has a relatively low natural frequency. This allows for slow engine running. A slow running engine allows more time for heating and cooling of the working fluid, which may allow for greater power delivery.

The coils of the resiliently deformable displacer may provide a significantly greater surface area than a conventional solid displacer piston allowing it to receive and store significant amounts of heat as the relatively hot working fluid is displaced to the cool end of chamber and return that heat to the relatively cool working fluid as it is displaced to the hot end of the chamber so that the displacer may function as a regenerator.

Figure 12:
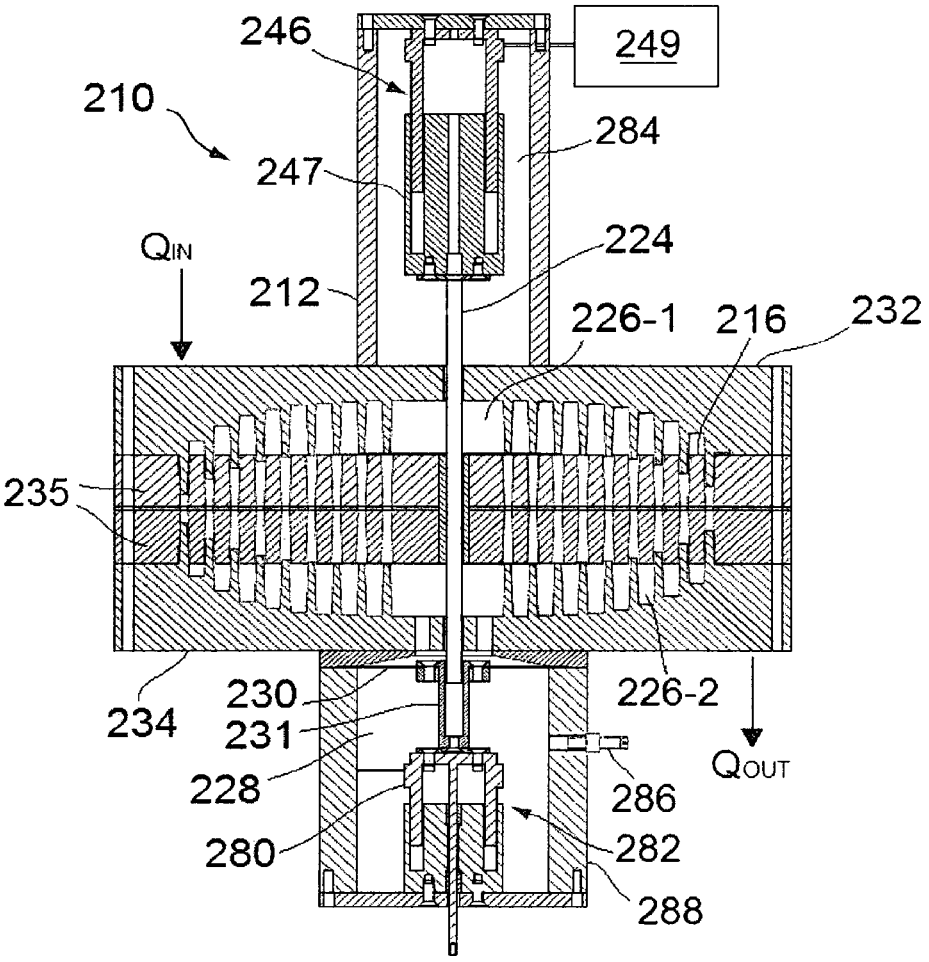
FIG. 12 is a section view of another example of a closed cycle regenerative heat engine.
Figure 13:
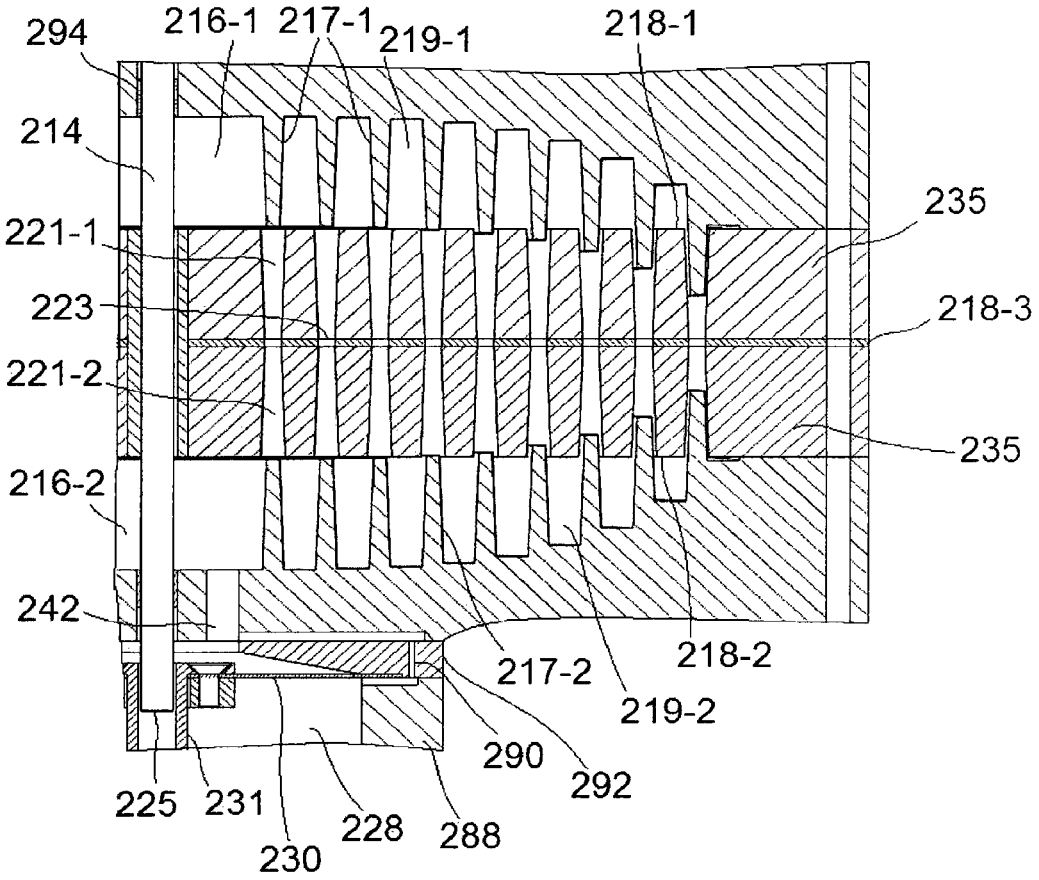
FIG. 13 is an enlargement of a portion of FIG. 12.

FIGS. 12 and 13 show another example of a closed cycle regenerative heat engine 210. Features of the closed cycle regenerative heat engine 210 that are the same as or similar to features of the closed cycle regenerative heat engine 10 are indicated by the same reference numerals incremented by 200 and may not be described in detail again.

The closed cycle regenerative heat engine 210 comprises a housing 212 defining a chamber that has a displacer compartment 226 having a hot end 226-1 and a cold end 226-2 and a diaphragm compartment 228. A resiliently deformable displacer 218 is housed in the displacer compartment 226. A diaphragm 230 is housed for reciprocating movement in the diaphragm compartment 228. The diaphragm compartment 228 is in fluid communication with the displacement compartment 226 so that working fluid heated in the displacement compartment 226 can act on the diaphragm 230.

In this example, there is no flywheel 46 and instead the shaft 224 connected to the displacer 218 is connected with a moving part 247 of a linear electric actuator 246, which in some examples may comprise a voice coil. The linear electric actuator 246 is supplied with electric current via a controller 249 such that the electric current causes the moving part 247 to reciprocate. The controller 249 may control the supply of electricity such that the moving part 247 may reciprocate at, or close to, the natural frequency of the displacer 218. Thus, the mechanical energy input to cause the displacer 218 to move between the hot and cold ends 226-1, 226-2 of the displacer compartment 226 is provided by the linear electric actuator 246 and controlled such that the displacer 218 reciprocates between the hot and cold ends 226-1, 226-2 at least substantially at its natural frequency.

In this example, the diaphragm 230 is moved by changes in the pressure of the working fluid to provide a mechanical energy output of the closed cycle regenerative heat engine 210. The mechanical energy output when the diaphragm 230 moves in response to the expansion of the heated working fluid is input to a moving part 280 of a linear electrical generator 282, which in some examples may be a voice coil. The diaphragm 230 may be connected to the moving part 280 by an elongate connecting member, or link, 231. The connector 231 may comprise a hollow shaft that is clamped to a central region of the diaphragm 230. The hollow shaft may receive the end 225 (FIG. 13) of the shaft 214 that is located remote from the linear electric motor 246. In use, when the working fluid expands and contracts as it is successively heated and cooled, the diaphragm 230 reciprocates causing linear reciprocating movement of the moving part 280, which in turn causes the linear electrical generator 282 to generate an electrical current that may be used to power electrical equipment or charge one or more batteries.

As best seen in FIG. 13, the resiliently deformable displacer 218 may be an elongate resilient strip comprising a composite structure, laminate structure or assembly, secured to the housing 212 between annular diaphragm mounts 235. The displacer 218 may comprise a first resilient coil 218-1, a second resilient coil 218-2 disposed opposite and spaced apart from the first resilient coil and a thermally insulating member 218-3 disposed intermediate and separating the first and second resilient coils. The resilient coils 218-1, 218-2 may be made of a metal such as aluminium, or an aluminium alloy. The thermally insulating member 218-3 should be capable of withstanding the operating temperatures within the displacer chamber 218 and is preferably an elastomer or polymer that is stable at relatively high temperatures. The thermally insulating member 218-3 may comprise a hard rubber or polyether ether ketone (PEEK). In use, the provision of a thermally insulating member 218-3 between the resilient coils 218-1, 218-2 may maintain a temperature gradient across the displacer 218 that is greater than is achievable with a conventional one-piece displacer piston so that the temperature of the resilient coil 218-1 disposed in the hot end 226-1 of the displacer compartment 226 stays at least relatively close to the temperature of the hot end 226-1 while the temperature of the resilient coil 228-2 disposed in the cold end 226-2 of the displacer compartment 218 stays at least relatively close to the temperature of the cold end 226-2. This may provide for more efficient heat transfer to the working fluid at the hot end 226-1 as for each cycle of the displacer 218, the resilient coil 218-1 should absorb less of the heat $Q_{IN}$ input at the first housing portion 232. Similarly, the heat transfer from the working fluid at the cold end 226-2 may be enhanced as the resilient coil 218-2 may remain relatively cooler than a conventional one-piece displacer piston operating in similar working conditions.

As in the previous examples, the displacer compartment 226 varies in diameter along its length. In particular, the hot end 226-1 increases in diameter towards the thermally insulating portion 236 and the cold end 226-2 decreases in diameter from the thermally insulating portion towards the diaphragm compartment 228. As best seen in FIG. 13, the first and housing portions 232, 234 may be provided with projections 227-1, 227-2 extending into the displacer compartment 226 at the hot and cold ends 226-1, 226-2 of the compartment. The projections 227-1, 227-2 may define respective convoluted passages 229-1, 229-2 into which the displacer 218 moves as it reciprocates between the hot and cold ends 226-1, 226-2 of the displacer compartment 226. The projections 227-1, 227-2 may comprising spiraling walls. The resilient coil 218-1 may at least substantially fill the passage 219-1 when the displacer is at the hot end 226-1 of the displacer compartment and the resilient coil 218-2 may at least substantially fill the passage 219-2 when the displacer is at the cold end 226-2. The projections 227-1, 227-2 provide additional surface area for heat transfer at the hot and cold ends 226-1. 226-2 of the displacer compartment 226, which may improve the efficiency of the respective heat transfer processes. Although not shown in the example illustrated by FIGS. 12 and 13, the or each projection 227-1 or the or each projection 227-2 may be hollow to allow the feed of a heating or cooling fluid through the projections as described above in connection with FIG. 11.

The resilient coils 218-1, 218-2 define respective spiraling channels 221-1, 221-2 that are connected via a spiraling channel 223 provided in the thermally insulating member 218-3. The spiraling channels 221-1, 221-2, 223 define a through-passage in the displacer 218 that allows working fluid to pass through the displacer to move between the hot and cold ends 226-1, 226-2 of the displacer compartment 226 as the displacer moves between the hot and cold ends. The spiraling channels 221-1, 221-2 may be configured to mate with the projections 227-1, 227-1 so as to reduce the dead volume in the displacer compartment.

In some examples, it may be desirable to pressurize the displacer compartment 226 prior to running the closed cycle regenerative heat engine 210 so that the initial pressure is above atmospheric. For example, the displacer compartment 226 may be pressurized to 2 atmospheres (approximately 200 kPa). In examples in which the displacer compartment 226 is pre-pressurized, it is desirable to ensure that the pressure on either side of the piston, or diaphragm, is balanced. FIGS. 12 and 13 show a pressurization system configured to allow pre-pressurization of the displacer compartment 226. Referring to FIG. 12, a valve 286 is provided in a wall 288 of the housing 212 that partially defines the diaphragm compartment 228. The valve 286 may be a one-way valve or, for example, a Schrader valve. Referring to FIG. 13, one or more bypass passages 290 may be provided to bypass the diaphragm 230 and allow working fluid to be pumped into the displacer compartment 226 via the valve 286 and diaphragm compartment 228. The or each bypass passage 290 may take any convenient form according to the particular configuration of the engine housing. In the illustrated example, a bypass passage 290 is shown comprising a through-hole in an annular housing member 292 disposed between the wall 288 and the second housing portion 234, a recess in an end of the wall 288 that is in flow communication with the upstream end of the through-hole and a recess in the second housing portion 234 that is in flow communication with the downstream end of the through-hole.

The operation of the closed cycle regenerative heat engine 210 is analogous to the operation of the closed cycle regenerative heat engine 10 as illustrated by FIGS. 4 to 9 and so will not be described in detail again. In similar fashion to the displacer 18 of the closed cycle regenerative heat engine 10, the displacer 218 of the closed cycle regenerative heat engine 210 fills the hot and cold ends 226-1, 226-2 when it reaches the respective ends of its reciprocating motion between the two ends.

In use, working fluid pumped in at the valve 286 passes from the diaphragm compartment 228 to the cold end 226-2 of the displacer compartment via the connecting passage 290 and two openings 242 that extend between the displacer compartment and the diaphragm compartment. From the cold end 226-2 of the displacer compartment 226, the pumped working fluid is able to flow to the hot end 226-1 of the displacer compartment 226 by passing through the spiraling channels 221-2, 221-2 and apertures 223 of the displacer 218. From the hot end 226-1, the pumped working fluid is able pass into the compartment 284 that houses the linear electrical actuator 246 via the clearance between the shaft 214 and a bearing 294 that supports the shaft 214. Thus, the displacer compartment 216, the diaphragm compartment 228 on both sides of the diaphragm 230 and the compartment 246 represent a closed system that can be pre-pressurized to a pressure above atmospheric that is substantially equal throughout the closed system so as not to adversely affect the operation of the moving parts of the engine in the chamber.

Figure 14:
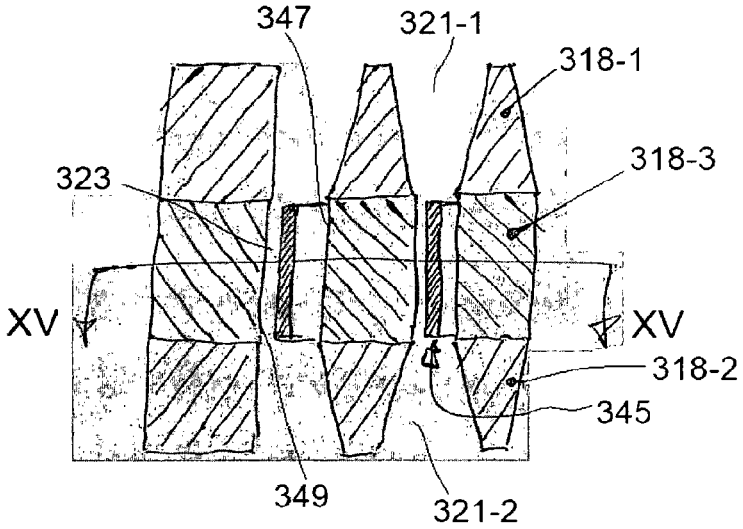
FIG. 14 is a cross-section view showing a modification of the displacer shown in FIGS. 12 and 13.
Figure 15:
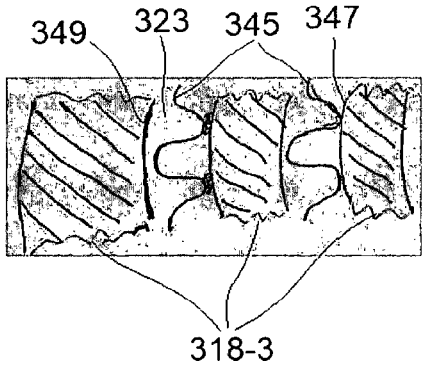
FIG. 15 is a section view on line XV-XV in FIG. 14.

FIGS. 14 and 15 shows a modification of the displacer 218 shown in FIGS. 12 and 13. The displacer 318 shown in FIGS. 14 and 15 may be an elongate resilient strip comprising a composite structure, laminate structure or assembly comprising a first resilient coil 318-1, a second resilient coil 318-2 disposed opposite and spaced apart from the first resilient coil and a thermally insulating member 318-3 disposed intermediate and separating the first and second resilient coils. The resilient coils 318-1, 318-2 may be made of a metal such as aluminium, or an aluminium alloy. The thermally insulating member 318-3 should be capable of withstanding the operating temperatures within the displacer chamber and is preferably an elastomer or polymer that is stable at relatively high temperatures. The thermally insulating member 318-3 may comprise a hard rubber or polyether ether ketone (PEEK). In this example, the displacer 318 may be provided with a heat storage reservoir 345 to store heat received from the working fluid when the working fluid is displaced from the hot end 226-1 of the displacer compartment to the cold end 226-2 and reject the stored heat to the working fluid with the working fluid is displaced from the cold end to the hot end.

The resilient coils 318-1, 318-2 define respective spiraling channels 321-1, 321-2 that are connected via a spiraling channel 323 provided in the thermally insulating member 318-3. The spiraling channels 321-1, 321-2, 323 define a through-passage in the displacer 318 that allows working fluid to pass through the displacer to move between the hot and cold ends of the displacer compartment as the displacer moves between the hot and cold ends. The spiraling channels 321-1, 321-2 may be configured to mate with the projections in similar fashion to the spiraling channels 221-1, 221-2 and the projections 227-1, 227-1 shown in FIG. 13.

In some examples, the depth of the thermally insulating member 318-3 may be increased as compared with the rather thinner thermally insulating member 218-3 that may be utilized in the displacer 218. The heat storage reservoir 345 may comprise a metal member fixed to the thermally insulating member 318-3. To increase the surface area available for heat transfer, the heat storage reservoir 318-3 may be corrugated. In some examples, the heat storage reservoir 318-3 may comprise corrugated aluminium, aluminium alloy or copper foil.

The width of the spiraling channel 323 is preferably kept small to minimize the dead volume and the heat storage reservoir 345 preferably occupies as much of the available width as is possible without rubbing against another part of the displacer 318. Thus, as illustrated in FIGS. 14 and 15, the heat storage reservoir 345 may be fixed to a face 347 of the thermally insulating member 318-3 that defines a side of the spiraling channel 323 and extend across at least substantially the entire width of the channel, but not so as to touch the opposite face 349.

It is to be understood that the heat storage reservoir 345 may be a single member or an assembly of members made of a material capable of absorbing heat from the working fluid. For example, the heat storage reservoir 345 may comprise a series of strips of metal fixed to the thermally insulating member 318-3.

Figure 16:
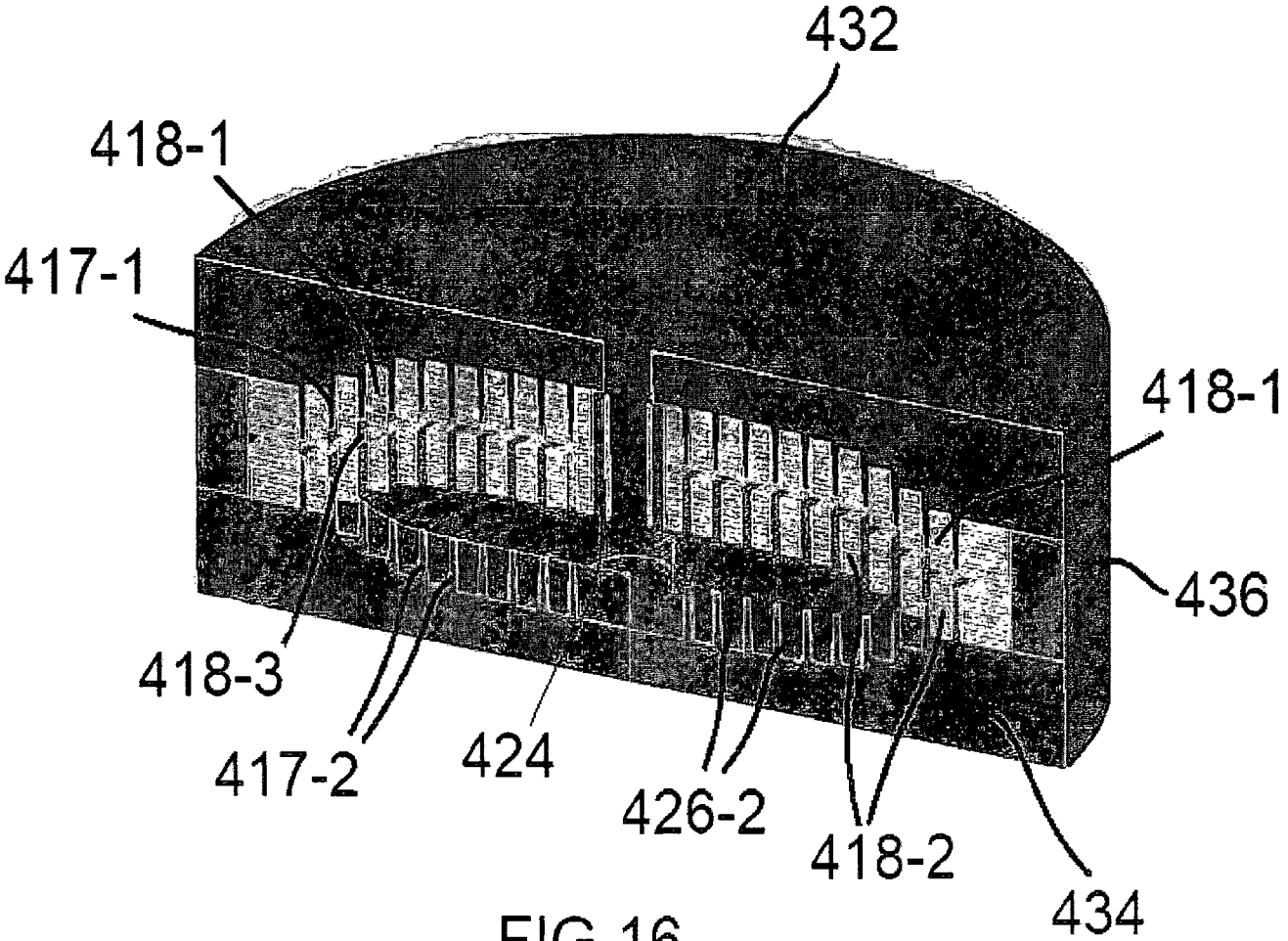
FIG. 16 is a cross-section view showing a resiliently deformable displacer that is a modification to the displacer shown in FIGS. 12 and 13.

FIG. 16 shows modification of the resiliently deformable displacer 218 shown in FIGS. 12 and 13. In the description of FIG. 16 that follows, parts the same as, or similar to parts shown in FIGS. 12 and 13 will be referenced by the same reference numerals incremented by 200 and for economy of presentation, may not be described again.

In the example shown in FIGS. 12 and 13, the resiliently deformable displacer 218 is a composite body that includes two resilient coils 218-1, 218-2 disposed in opposed spaced apart relation separated by a thermally insulating member 218-3 so as to provide the resiliently deformable displacer with respective relatively hot and relatively cold sides. In the modified example shown in FIG. 16, the resiliently deformable displacer 418 has two resilient coils 418-1, 418-2 disposed in opposed spaced apart relation in analogous fashion to the resilient coils 218-1, 218-2, but instead of being separated by a thermally insulating member, the two coils are separated by a thermal break comprising a laterally expanding space or volume 418-3 that may be referred to as an air gap 418-3. Although having a thermal break in the form of a thermally insulating member separating the two sides of the resiliently deformable displacer 218 results in the displacer having relatively hotter and colder sides than in the case of displacers such as those shown in FIGS. 1 to 11 that have no thermal break between the two sides of the displacer, there is still the potential for considerable conductive heat transfer between the two resilient coils 218-1, 218-2. By providing a thermal break comprising an air gap 418-3 between the two resilient coils 418-1, 418-2, the potential for conductive heat transfer is at least considerably reduced as there will be no conductive heat transfer via the air in the air gap, which will be constantly moving as the resiliently deformable displacer reciprocates back and forth in the displacer compartment 426-1, 426-2. Similarly, there will be no convection via the constantly moving air. Thus, the only mode of heat transfer across the air gap 418-3 is by radiation. However, this can be minimized if the facing surfaces of the two resilient coils 418-1, 418-2 are given a good silver finish. A further advantage to using an air gap 418-3 to insulate between the two resilient coils 418-1, 418-2 is that a plastics thermally insulating member will tend to act as a damper, so that more energy is required to drive a resiliently deformable displacer provided with such a resiliently deformable member. It is to be understood that references to the thermal break 418-3 as an air gap are not to be taken as limiting as the working fluid that fills the space between the two resilient coils 418-1, 418-2 need not be air.

Figure 17:
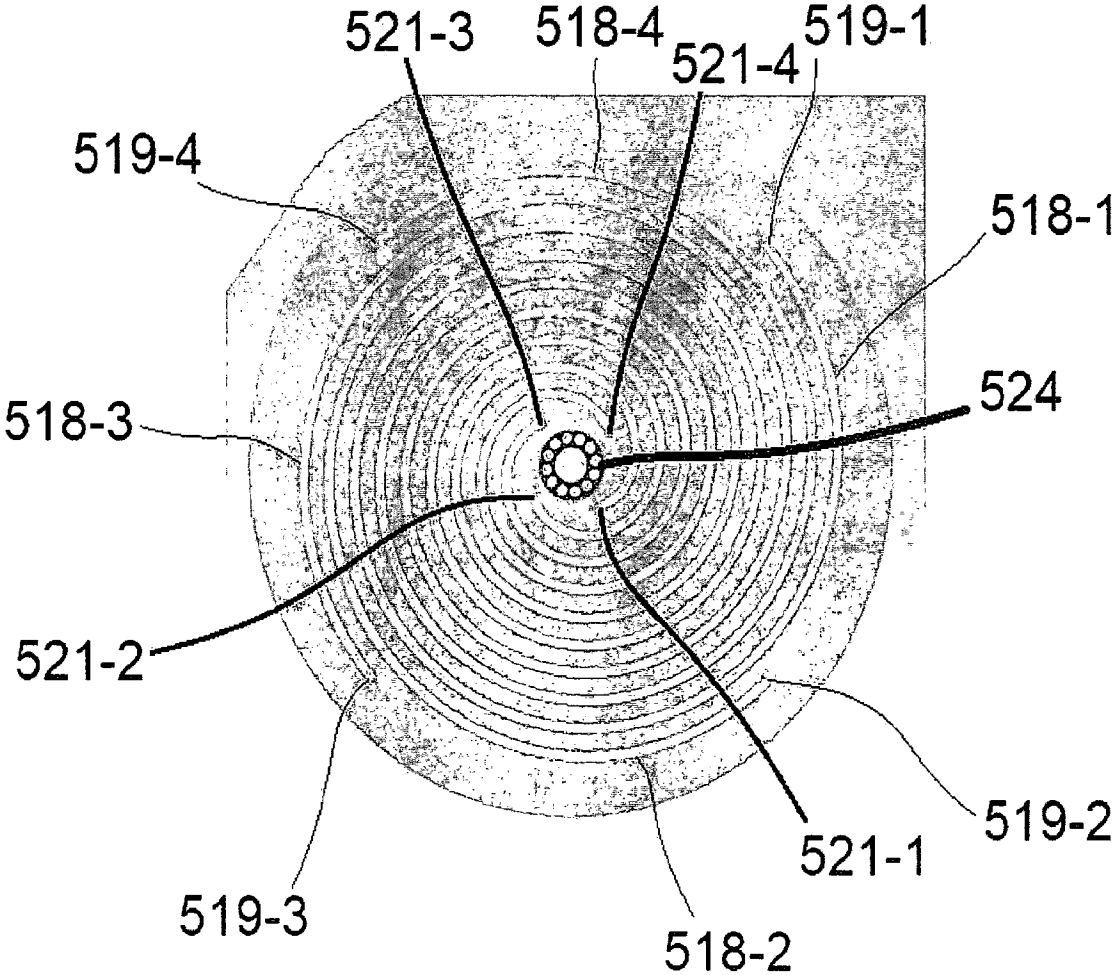
FIG. 17 is a schematic plan view of a resiliently deformable displacer in the form of a four-start volute spring.

The resilient member or members that form resiliently deformable displacers shown in FIGS. 1 to 11 each comprises a resilient member that has a first, or starting, end connected to the engine housing and a second end connected to the reciprocating engine shaft. Similarly, in the examples shown in FIGS. 12 to 16, the two resilient members that form the resiliently deformable displacer have respective first, or starting, ends connected to the engine housing and respective second ends connected to the reciprocating engine shaft. This is not essential. For example, as shown in FIG. 17, the resiliently deformable displacer 518 comprises four resiliently deformable members 518-1 to 518-4 having respective first, or starting, ends 519-1 to 519-5 connected to the housing 512 and respective second ends 521-1 to 521-4 connected to the reciprocating shaft 524. The resiliently deformable members 518-1 to 518-4 may have substantially the same length and height and in directions perpendicular to the longitudinal axis of the shaft 524 may be disposed in the same planes so as to define a resiliently deformable displacer 518 comprising a four-start volute spring. In analogous fashion, instead of comprising two resilient members disposed in opposed spaced apart relationship, the resiliently deformable displacers illustrated by FIGS. 12 to 16 may comprise two four-start multi-volute springs disposed in opposed spaced apart relationship and separated by a thermally insulating member as shown in FIGS. 12 to 15 or an air gap as shown in FIG. 16. It will be understood that while FIG. 17 shows the multi-start displacer spring as a four-start spring, this is not essential. A multi-start displacer spring or springs for a resiliently deformable displacer suitable for use in the examples of a closed cycle regenerative heat engine shown in FIGS. 1 to 16 may comprise any number of starts, for example two or a number greater than two.

A resiliently deformable displacer comprising one or more multi-start springs may provide a more uniform heat distribution across the displacer in directions transverse to the longitudinal axis of the reciprocating shaft 524. With a single-start spring, the temperature in the spring may only be at least substantially the same as the temperature of the housing portion to which it is connected over the first turn, or spiral, of the spring. With a four-start spring, the first turn, or spiral, is four times closer to the center of the resiliently deformable displacer than the first turn, or spiral, of a single-start spring.

A closed cycle regenerative heat engine embodying one or more of the operating features described above has a resiliently deformable displacer that has a portion that is anchored so that it cannot move and a portion that is connected with a reciprocating shaft or other moving part. As the shaft reciprocates, the displacer deforms so as to move a working fluid between respective heating and cooling locations in a chamber. The shaft may be driven by a flywheel powered by the engine output or an electrical actuator. The shaft may reciprocate at or near the natural frequency of the resiliently deformable displacer. This may reduce the input energy needed to operate the displacer and so increase the efficiency of the engine. In some examples, a frequency adjuster may be provided to tune the natural frequency of the displacer to the engine drive speed.

As the working fluid moves between the respective heating and cooling locations, it passes through the resiliently deformable displacer. As compared with a conventional one-piece piston displacer, this may significantly increase the surface area of the displacer available for heat exchange with the working fluid.

In some examples, the displacer may comprise first and second members, or body parts, separated by a thermal break comprising thermal insulation. One of the first and second members is disposed on the side of the heating location and the other is disposed on the side of the cooling location. The effect of the thermally insulating layer may be to prevent, or at least significantly inhibit heat transfer between the first and second members. Thus, the member on the side of the heating location will be maintained at a relatively higher temperature than the member on the side of the cooling location. Accordingly, the first and second members will be maintained at a temperature the same as, or at least closer to, the temperature of the respective heating and cooling locations, thereby potentially increasing the efficiency of the heat transfer processes affecting the working fluid at the heating and cooling locations. The thermal break may comprise a laterally extending space or gap separating the two sides, or ends, of the resiliently deformable displacer. In some examples first and second body portions may each have a width in a first direction and the displacer moves in second and third directions that are transverse to that first direction, typically perpendicular to that direction, and the space, or gap, between them defining the thermal break may extend over at least 80% of that width. It will be understood that the depth of the space measured in the second and third directions may be small compared with the width of the displacer sufficient to at prevent thermal conduction across the thermal break. Thus, by way of example, the depth of the space, or gap, may be between 0.5 and 2.00 mm. It will be understood that in examples such as that shown illustrated by FIG. 17, the first and second body portions may comprise a plurality of separate members with each set of members spaced from the other by the thermal break.

In some examples, provision may be made for pre-pressurizing the working fluid. This may provide for improved power output. A pressurization system may be provided to allows pressurization of the working fluid. The pressurization system includes one or more passages or clearances between components to allow the pressurization to affect all parts of the engine chamber in which moving parts associated with the displacer and power piston or diaphragm are housed so that the pressures acting on those parts are at last substantially balanced.

In conventional Stirling engines, there is a significant clearance between the displacer piston and the walls of the cylinder. This is to allow the working fluid to pass around the displacer piston when moving between the heating and cooling locations. This means that when the displacer piston is at the respective ends of its reciprocating movement there is a dead space around the displacer piston containing a significant body of working fluid. This reduces the overall efficiency of the engine. In the illustrated examples of a closed cycle regenerative engine, the resiliently deformable displacer at least substantially fills the heating and cooling locations when at the ends of its reciprocating movement. In the example illustrated by FIGS. 1 to 9, the resiliently deformable displacer deforms so as to leave substantially no gap between the outer periphery of the displacer and the housing and the internal through-passage through which the working fluid passes as it moves between the heating and cooling locations is closed up. In similar fashion, in the examples shown in FIGS. 10 to 17, the resiliently deformable displacers leave substantially no gap between the outer periphery of the displacer and the housing and the internal through-passage through which the working fluid passes as it moves between the heating and cooling locations is blocked. Blockage of the internal through-passage may be partly due to deformation of the resiliently deformable displacer and partly due to the projections entering the internal through-passage. When the displacer is filling the heating and cooling locations, an outer periphery of the displacer may virtually, or actually, engage the housing so that there is no dead space surrounding the displacer. This may increase the efficiency of the closed cycle regenerative heat engine by ensuring that a larger volume of the working fluid is heated and cooled at the heating and cooling locations.

Thus, although there have been described particular embodiments of the present invention of a new and useful Closed Cycle Regenerative Heat Engines it is not intended that such references be construed as limitations upon the scope of this invention except as set forth in the following claims.

What is claimed is:

1. A closed cycle regenerative heat engine comprising:

a housing defining a chamber;

a resiliently deformable displacer housed in said chamber; and a movable member housed in said chamber, wherein said displacer is configured to resiliently deform in said chamber to displace a working fluid between respective heating and cooling locations in said chamber at which heat is input to said working fluid and said working fluid is cooled, said displacer comprises a first resiliently deformable body portion and a second resiliently deformable body portion disposed opposite said first body portion, each said body portion having a periphery that is secured relative to said housing and being configured such that when said displacer resiliently deforms to displace said working fluid into said cooling location, said first resiliently deformable body portion resiliently deforms into said heating location and when said displacer resiliently deforms to displace said working fluid into said heating location, said second resiliently deformable body portion resiliently deforms into said cooling location, wherein an air gap is defined between said first and second body portions to at least reduce heat conduction between said first and second body portions, and said movable member is in sealing engagement with said housing and movable in response to pressure changes of said working fluid caused by said heating and cooling of said working fluid to provide a mechanical power output.

2. A closed cycle regenerative heat engine as claimed in claim 1, wherein said first and second body portions have a width in a first direction and said displacer is movable in oppositely directed second and third directions that are transverse to said first direction.

3. A closed cycle regenerative heat engine as claimed in claim 2, wherein said air gap extends over at least 80% of said width.

4. A closed cycle regenerative heat engine as claimed in claim 1, wherein at least one of said first and second resiliently deformable body portions comprises at least one spiraling member.

5. A closed cycle regenerative heat engine as claimed in claim 1, wherein said air gap contains said working fluid.

6. A closed cycle regenerative heat engine, comprising:

a housing defining a chamber;

a displacer housed in said chamber; and a movable member housed in said chamber, wherein said displacer is movable in said chamber to displace a working fluid between respective heating and cooling locations in said chamber at which heat is input to said working fluid and said working fluid is cooled, said displacer comprises a first body portion and a second body portion disposed in opposite said first body portion and configured such that when said displacer moves to displace said working fluid into said cooling location, said first body portion moves into said heating location and when said displacer moves to displace said working fluid into said heating location, said second body portion moves into said cooling location, wherein a gap is defined between said first and second body portions to at least reduce heat conduction between said first and second body portions and at least one of said first and second body portions comprises a multi-start volute spring, and wherein said movable member is in sealing engagement with said housing and movable in response to pressure changes of said working fluid caused by said heating and cooling of said working fluid to provide a mechanical power output.

7. A closed cycle regenerative heat engine comprising:

a housing defining a chamber;

a resiliently deformable displacer housed in said chamber; and a movable member housed in said chamber, wherein said resiliently deformable displacer is movable in said chamber to displace a working fluid between respective heating and cooling locations in said chamber at which heat is input to said working fluid and said working fluid is cooled, said resiliently deformable displacer defines at least one internal through-passage such that, in use, when said displacer moves to displace said working fluid between said heating and cooling locations, said working fluid passes through said resiliently deformable displacer, a heat storage reservoir mounted on said resiliently deformable displacer to, in use, store heat received from said working fluid when said working fluid is displaced from said heating location to said cooling location via said at least one internal through-passage and reject said stored heat to said working fluid when said working fluid is displaced from said cooling location to said heating location via said at least one internal through-passage, and said movable member is in sealing engagement with said housing and movable in response to pressure changes of said working fluid caused by said heating and cooling of said working fluid to provide a mechanical power output.

8. A closed cycle regenerative heat engine as claimed in claim 7, wherein said heat storage reservoir comprises a corrugated metal member.

9. A closed cycle regenerative heat engine as claimed in claim 7, wherein said resiliently deformable displacer is secured to a wall of said chamber.

10. A closed cycle regenerative heat engine as claimed in claim 9, wherein said housing comprises a first housing portion at which, in use, heat is input to said chamber from an external source to heat said heating location, a second housing portion at which, in use, heat is rejected from chamber to cool said cooling location and a thermally insulating portion disposed intermediate said first and second housing portions, and said wall to which said resiliently deformable displacer is secured is defined by said thermally insulating portion.

11. A closed cycle regenerative heat engine as claimed in claim 7, wherein said resiliently deformable displacer deforms to reciprocate between said heating and cooling locations along a first axis in said chamber and said movable member reciprocates along a second axis that is perpendicular to said first axis.

12. A closed cycle regenerative heat engine as claimed in claim 7, wherein said resiliently deformable displacer further comprises a first resilient member and a second resilient member and a thermally insulating member disposed intermediate said first and second resilient members to thermally insulate said first resilient member with respect to said second resilient member.

13. A closed cycle regenerative heat engine as claimed in claim 7, wherein said resiliently deformable displacer comprises a multi-start volute spring.

14. A closed cycle regenerative heat engine as claimed in claim 7, further comprising at least one projection extending into said chamber at one of said respective locations, wherein said at least one projection defines a convoluted passage and said resiliently deformable displacer is deformable to enter said convoluted passage when displacing said working fluid to the other of said respective locations.

15. A closed cycle regenerative heat engine as claimed in claim 14, wherein at said at least one projection is hollow.

16. A closed cycle regenerative heat engine as claimed in claim 7, wherein said resiliently deformable displacer is connected with a shaft and said shaft is connected with an electrical actuator configured to drive said resiliently deformable displacer.

17. A closed cycle regenerative heat engine as claimed in claim 16, wherein said electrical actuator is configured to drive said resiliently deformable displacer at a natural frequency of said resiliently deformable displacer.

18. A closed cycle regenerative heat engine as claimed in claim 7, wherein said movable member comprises a piston or a diaphragm.

19. A closed cycle regenerative heat engine comprising:

a housing defining a chamber;

a displacer housed in said chamber; and a movable member housed in said chamber, wherein said displacer is movable in said chamber to displace a working fluid between respective heating and cooling locations in said chamber at which heat is input to said working fluid and said working fluid is cooled, said displacer comprises a first body member, a second body member and a thermally insulating member intermediate said first and second body members and configured such that when said displacer moves to displace said working fluid into said cooling location, said first body member moves into said heating location and when said displacer moves to displace said working fluid into said heating location, said second body member moves into said cooling location, said displacer further comprises a heat storage reservoir mounted on said thermally insulating member to, in use, store heat received from said working fluid when said working fluid is displaced from said heating location to said cooling location and reject said stored heat to said working fluid when said working fluid is displaced from said cooling location to said heating location, and said movable member is in sealing engagement with said housing and movable in response to pressure changes of said working fluid caused by said heating and cooling of said working fluid to provide a mechanical power output.

20. A closed cycle regenerative heat engine as claimed in claim 19, wherein:

said displacer is a resiliently deformable displacer;

said chamber comprises a first compartment that houses said displacer, said first compartment has a first end, a second end and a width that increases from said first end towards an intermediate region and decreases from said intermediate region to said second end, and said resiliently deformable displacer and said first and second ends are configured such that when, in use, said resiliently deformable displacer has displaced said working fluid to said cooling location said resiliently deformable displacer fills said first end and when said resiliently deformable displacer has displaced said working fluid to said heating location said resiliently deformable displacer fills said second end.

* * * * *